United States Patent [19]

Volakakis et al.

[11] Patent Number: 4,688,688

[45] Date of Patent: Aug. 25, 1987

[54] JIB CRANE ARRANGEMENT HAVING A ROTATABLE MAST

[75] Inventors: John G. Volakakis, La Grange; Robert L. McNelis, Glen Ellyn; Burt H. Wallentim, La Grange, all of Ill.

[73] Assignee: Handling Systems, Inc., La Grange, Ill.

[21] Appl. No.: 767,255

[22] Filed: Aug. 21, 1985

Related U.S. Application Data

[63] Continuation-in-part of Ser. No. 384,883, Jun. 4, 1982, Pat. No. 4,511,048, and a continuation of Ser. No. 573,290, Jan. 23, 1984, abandoned.

[51] Int. Cl.[4] ..... B66C 23/02

[52] U.S. Cl. ..... 212/253; 212/223; 212/269; 384/281; 384/282; 384/300

[58] Field of Search ..... 212/195, 205, 209, 223, 212/225, 226, 245, 253, 227, 228, 253, 223, 209; 308/3 R, 4 R, 5 R, 49, DIG. 5, DIG. 8, DIG. 9; 384/279, 282, 300, 281, 280, 295

[56] References Cited

U.S. PATENT DOCUMENTS

| | | | |
|---|---|---|---|
| 1,534,797 | 4/1925 | McLeod | 212/226 |
| 1,721,777 | 7/1929 | Gluckstein | 212/253 |
| 1,865,762 | 7/1932 | Kaltenbach | 212/225 |
| 2,170,545 | 8/1939 | Burton | 384/281 |
| 2,449,662 | 9/1948 | Leeson | 384/280 |
| 2,828,872 | 4/1958 | Mangel | 212/228 |
| 2,998,397 | 8/1961 | Riesing | 384/300 |
| 3,352,612 | 11/1967 | Eudier | 384/279 |
| 3,464,882 | 9/1969 | Morton | 384/300 |
| 3,774,983 | 11/1973 | Lagally | 384/280 |
| 3,782,790 | 1/1974 | Benkowski | 212/269 |
| 4,004,695 | 1/1977 | Hockensmith et al. | 212/269 |
| 4,426,162 | 1/1984 | Tsuchiya et al. | 384/280 |

FOREIGN PATENT DOCUMENTS

| | | | |
|---|---|---|---|
| 482548 | 3/1917 | France | 212/223 |
| 102206 | 5/1923 | Switzerland | 212/225 |
| 884 | of 1865 | United Kingdom | 212/223 |
| 1016701 | 1/1966 | United Kingdom | 212/253 |

*Primary Examiner*—Joseph F. Peters, Jr.
*Assistant Examiner*—Thomas Brahan
*Attorney, Agent, or Firm*—Jerome Goldberg

[57] ABSTRACT

A jib crane system comprising a horizontally extending load beam rigidly attached to the upper end of a vertically extending mast. The lower part of the mast is positioned inside a hollow structure such as a pipe and is rotatably associated therein, and spaced from the inside surface of the pipe. A bearing boot is rigidly secured to the mast and in frictional contact with the inside surface of the pipe. The bearing boot slides around the inside circumference of the pipe in a circular or arcuate path as the mast and load beam revolve around the central axis of the mast. The bearing boot includes an outer arcuate concave contacting plate having substantially the same radius as the inside convex surface of the pipe. A ring of foil may be secured on the inside of the pipe for providing the sliding surface for the bearing boot. The mast may comprise a flanged beam having a pair of side walls with a web portion therebetween. The web may be split at the upper part thereof into two sections which are angularly spaced apart and the split sections attached at their upper ends to the rear end of the beam. Alternatively, a rod means may be secured at the upper end to the rear end of the load beam and extending angularly downward and inward therefrom for attachment to the mast at the lower end thereof.

4 Claims, 22 Drawing Figures

JIB CRANE ARRANGEMENT HAVING A ROTATABLE MAST

This Application is a continuation-in-part of our Application filed on June 4, 1982, entitled "JIB CRANE SYSTEM HAVING A ROTATABLE MAST," under Ser. No. 384,883, U.S. Pat. No. 4,511,048, and a continuation of Application Ser. No. 573,290 filed 1/23/84, now abandoned.

BACKGROUND OF THE INVENTION

This invention relates generally to cranes; more specifically relates to cranes which rotate around a central axis, such as jib cranes; and still more specifically relates to cranes having a rotatable vertical mast.

The cranes having a rotatable mast such as the jib cranes described in our said prior application comprises a base assembly, an upright column or mast which may have a wide flange or "I" beam structural shape rotatably mounted to the base assembly, and a horizontally extending boom or load beam rigidly secured to the upper end of the mast. A trolley including a hoist is movably mounted on the load beam. The trolley and hoist may be operated by electric or hand power. The bottom part of the mast is positioned inside a hollow structural member such as a pipe and spaced from the inside surface thereof, and rotatably associated therein. Force transfer means, such as roller means, were rigidly secured to the mast. The rollers frictionally contacted the pipe and revolved around the circumference of the pipe as the mast and load beam rotated around the central axis of the pipe.

In order to properly position the roller means, a section was cut out from the mast column and the holder or cage containing the roller means was welded or otherwise rigidly attached to the mast. Prior to making such attachment, the roller means were positioned to provide the proper contact with the pipe and also the proper plumbness of the mast. Alternatively, two rollers housed in separate cages could be used and secured to the column without requiring a section to be cut from the column.

The subject invention still further simplifies the force transfer means by providing a bearing boot to replace the roller means, and the bearing is rigidly secured to the column structure of the mast and frictionally contacts the inside surface of the pipe, as the mast rotates. The bearing boot revolves in a sliding manner on the pipe surface. The boot appreciably reduces the labor required for constructing and assembling the crane, as compared with the crane system having the roller means.

In the prior jib crane systems, the rotating of the load beam, from time to time, generated excessive lateral forces causing instability and "kick up" of the mast. In the present invention, a guard or baffle is mounted to the mast at a position substantially opposed to the force transfer means (roller means or bearing boot), to provide stability and prevent "kick up" of the mast.

SUMMARY OF THE INVENTION

The jib crane system of this invention includes a rotatable mast secured at the upper end to a load beam and a lower end positioned inside a hollow structural member such as a pipe and spaced from the inside wall thereof. The pipe is rigidly mounted to a base plate or other suitable support. A bearing boot is fixedly secured to the mast and in frictional contact with the inside of the pipe as the mast rotates around its own axis. Preferably, the inside surface of the pipe is machined or prepared to a smooth finish for minimizing friction along the pathway of the boot sliding on the inside surface of the pipe. Alternatively, a stainless steel ring of foil may be secured to the inside surface of the pipe to provide the smooth contacting surface for the boot.

The bearing boot comprises a concave outer surface derived from a radius substantially the same as the radius forming the inside curvature of the pipe. Preferably, the material of the outer surface should have a coefficient of friction substantially less than the coefficient of friction of the contacting surface of the pipe.

In order to reduce load beam deflection under heavy load conditions, the mast may be constructed into a "Y" configuration having a pair of branches and a stem. The branches are attached at their upper ends to the rear part of the load beam and junction at their lower ends with the upper end of the stem. A piece of material may be inserted and secured between the branches and also secured to the rear part of the load beam.

Instead of the "Y" beam configuration, a rod means may be attached at the upper end to the rear end of the load beam and extending angularly downward and inward therefrom for attachment to the mast at the lower end thereof. Preferably, such attachment is on the side of the mast opposed to the location of the bearing boot (or other means used for transferring the force from the rotating mast to the fixed mounted structural member).

It is therefore a primary object of this invention to provide simplified means for enabling the mast to be constructed from wide flange beam, "I" beam, rectangular channel, rectangular tubing, cylindrical pipe or other suitable mast structure.

Another primary object of this invention is to provide a jib crane having a rotatable upright mast mounted to a substantially horizontal extending load beam.

A primary feature of the invention is to provide a bearing boot having an arcuate outer contacting surface for sliding in an arcuate or circular path around a cylindrical pipe as the mast is rotated, for transferring force to the pipe.

Another primary feature is to secure a ring of foil around the inside of a hollow structural member, such as a pipe, to provide a smooth sliding surface for the bearing boot.

Still another primary feature of the invention is to provide a mast beam split at the upper part thereof into two sections, angularly spaced apart, and the upper ends are attached to the rear of the load beam for affording greater support for the load beam and thereby reducing deflection under heavier load conditions. A related feature is to insert and secure a piece between the split sections and also securing the piece to the rear end of the load beam, to provide additional support.

Still another feature is to provide a bearing boot having a radius for forming the outer surfaces thereof, substantially the same as the radius of the contacting fixed mounted surface.

Still another object is to provide means for minimizing or substantially preventing "kick up" of the mast during the rotating of the load beam.

Yet another feature is to provide a rod means secured at the upper end to the rear part of the load beam and angled downward and inward for attachment to the mast at the lower end thereof. A related feature is to attach the lower end of the rod means to the side of the mast opposed to the location of the force transfer means (roller means or boot).

BRIEF DESCRIPTION OF THE DRAWINGS

Referring now to the drawings, in which the same characters of reference are employed to indicate corresponding similar parts throughout the several figures of the drawings:

FIG. 9 is a front elevational view of a fabricated steel section;

FIG. 10 illustrates a vertical cut through the upper portion of the fabricated section and showing an upper part of the section in phantom bent away from the adjacent upper part;

FIG. 11 illustrates the fabricated section having one upper part bent away from the adjacent upper part;

DESCRIPTION OF THE PREFERRED EMBODIMENT

Figures 1, 2, 3, 4, 5, 6, 7, 8:
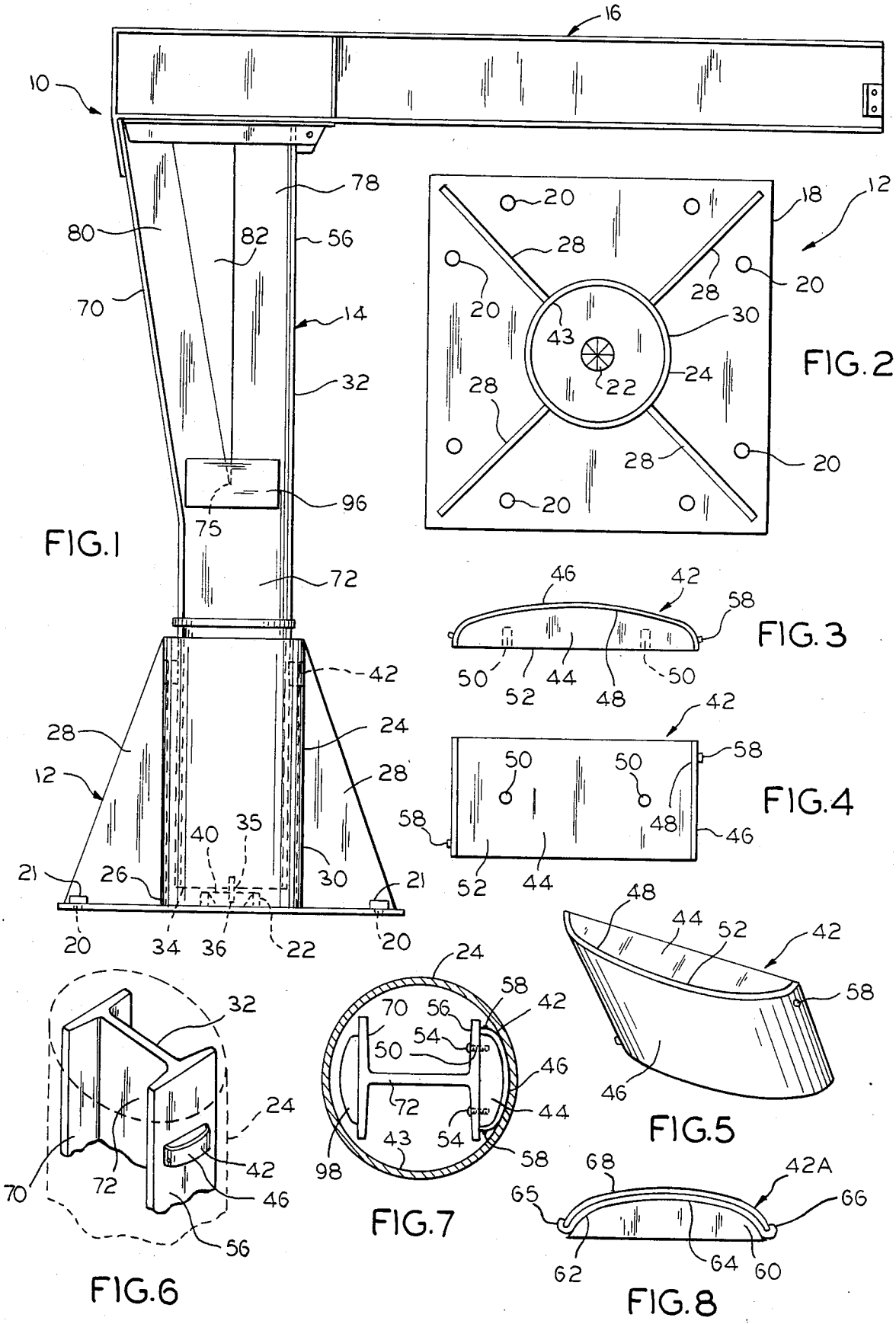
FIG. 1 is a side elevational view of a jib crane, embodying the principles of the invention.
FIG. 2 is a top view of the base assembly of FIG. 1.
FIG. 3 is a top view of the bearing boot means.
FIG. 4 is a back view of the bearing boot means.
FIG. 5 is a perspective front view of the bearing boot means.
FIG. 6 illustrates the bearing boot means mounted on the mast and showing the cylindrical pipe in phantom.
FIG. 7 is a top view showing the bearing boot means in contact with the pipe and a baffle positioned on the opposite side of the mast and spaced from the inside wall of the pipe.
FIG. 8 illustrates an alternative embodiment for the bearing boot means and showing the outer bearing strip resiliently secured in the holder.

Referring now to FIG. 1 of the drawing, the reference numeral 10 indicates generally a jib crane comprising a base assembly 12, a mast assembly 14 and a load beam or boom 16.

The base assembly 12 includes a base plate 18 (FIG. 2) of a square shape and having a plurality of mounting holes 20 spaced inward from the outer periphery. Anchor bolts 21 are received in the holes 20 and fasten the jib crane 10 to the floor or foundation. A tapered thrust bearing cup and housing 22 (FIGS. 1 and 2) which may have a bevel gear or other suitable gearing on the inside thereof, is welded or otherwise rigidly secured to the center of the plate 18. A hollow circular and open ended pipe 24 is positioned over the bearing cup and housing 22 and is welded or otherwise rigidly secured at its lower end 26 to the plate 18. Spaced apart gusset pates 28 of a substantially right triangular shape are welded to the plate 18 and to the outer wall 30 of the pipe 24 to provide support for the pipe 24.

The mast assembly 14 includes a fabricated wide flange section beam or pillar 32. The pillar 32 may also be constructed from "I" beam, fabricated plate, rectangular tubing or pipe. The loading of the jib crane 10 will determine the various vertical structures which may be suitably and economically used. The width or diameter of the pillar 32, as the case may be, is less than the internal diameter of the pipe 24, so that it may be positioned therein.

The bottom end 34 of the pillar 32 includes a cut out 35 (FIG. 1) centrally positioned to receive a pin 36, preferably constructed from steel. The pin 36 is welded to the defining edges of the cutout 35 and protrudes downward from the bottom end 34 of the pillar 32.

A tapered bearing 40 or other suitable bearing is secured on the pin 36. When the pillar 32 is lowered into the pipe 24, bearing 40 meshes with the complementary gearing of the bearing cup 22, and the pillar 32 is now rotatable.

Turning now more specifically to FIGS. 3 through 7, it will be seen that a bearing boot indicated generally by the reference numeral 42 is attached to the pillar 32 at a predetermined level therealong, for frictionally contacting the inside surfaces 43 of the pipe 24 (see FIG. 7). The boot 42 includes a support head 44 and an arcuate or curved contacting strip 46 fixedly secured to the front face 48 of the head 44. The strip 46 maintains frictional contact with the inside surface 43 of the pipe 24 as the mast is rotated.

The outer surface of the strip 46 is extremely smooth to minimize frictional contact between the boot 42 and the inside surface 43 of the pipe 24. The coefficient of friction of the strip 46 of the boot 42 is substantially less than the coefficient of friction of the inside contacting surface 43 of the pipe 24, so that the boot 42 easily slides around the inside of the pipe 24 as the mast 14 is rotated.

A preferred material for the strip 46 has a low coefficient of friction. A suitable material for the contacting strip 46 has been found to be a self lubricating bearing material having a porous bronze structure impregnated and overlaid with PTFE (polytetrafluoroethylene) and lead. The effect of this material is to transfer film for effectively coating the mating surface to form an oxide type lubricant film. As the film is depleted, the relative motion of the mating surface continues to draw material from the porous bronze layer. This material is known by the trademark self-lubricating "DU" bearings sold and distributed by GARLOCK BEARING, Inc., subsidiary of COLT Industries, Inc.

The arc of the strip 46 has substantially the same radius as the radius of the internal surface 43 of the pipe 24. The strip 46 may be bent into such arc when positioned on boot 42.

A pair of openings 50 extend inward from the rear face 52 of the head 44 to receive a pair of screws 54 (FIG. 7) for attaching the boot 42 to the side wall 56 of the pillar 32. A pair of screws 58 are used to secure the contacting strip 46 to the front face 48 of the head 44. A bonding means may be used instead of the screws 58. Preferably, such bonding means should not prevent the removal of the strip 46 when the strip is worn out and requires replacement with a new strip 46.

The front face 48 of the head 44 is arcuately shaped to substantially the same curvature as the internal surface 43 of the pipe 24. The contacting strip 46 is flexible, and is bent or stressed to the same curvature as the front face 48 of the head 44 and secured in place with screws 58. The boot 42 revolves in a sliding motion around and in contact with the inside surface 43 of the pipe 24 as the mast 14 rotates.

Turning now to FIG. 8, an alternative embodiment for the boot indicated generally by numeral 42 and suffix "A" is illustrated. The boot 42A includes a support head 60 and a holder 62 mounted on the front face 64 of the head 60. The opposite ends of the holder 62 are bent into an arc shape to form resilient gripper members 65 and 66. A contacting strip 68 which is flexible is bent into the same arc as the front face 64 of the head 60, and inserted into the gripping members 65, 66. Thus, the contacting strip 68 may be easily removed and replaced when worn out.

Figure 9:
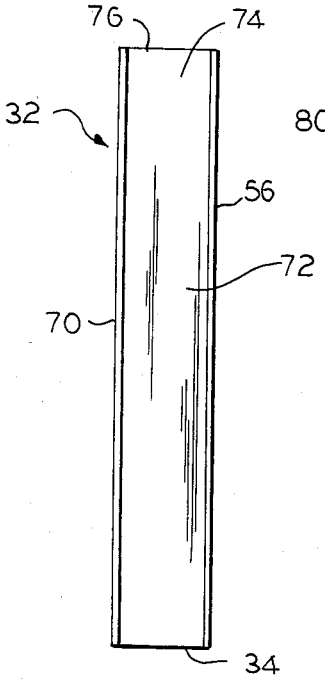
FIGS. 9, 10 and 11 illustrate the bending of the upper part of a fabricated steel section used for forming the mast of the crane.
Figure 10:
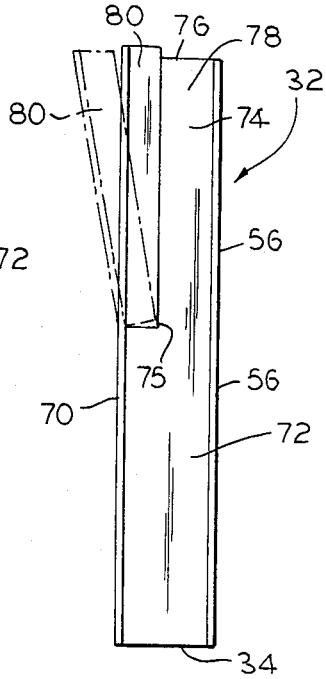
Figure 11:
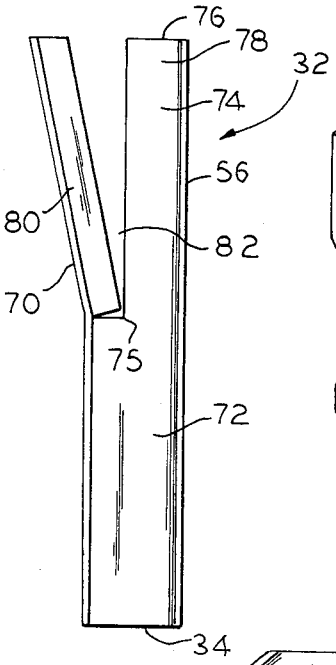

Referring now to FIGS. 9, 10 and 11, it will be seen that the fabricated wide flange beam 32 (FIG. 9) comprises the side wall or flange 56, side wall or flange 70 and a web 72 between the flanges 56,70. The upper part 74 of the web 72 is split longitudinally to a point 75 at a vertical level intermediate between the top end 76 and the bottom end 34, to divide the upper part 74 into sections 78,80 (FIG. 10).

By applying intense heat at the point 75, section 80 is bent outwardly so that it is angled away from section 78 (FIG. 11) to form a triangular space 82 between sections 78,80 and said point 75 being the apex of the space 82.

Figure 12:
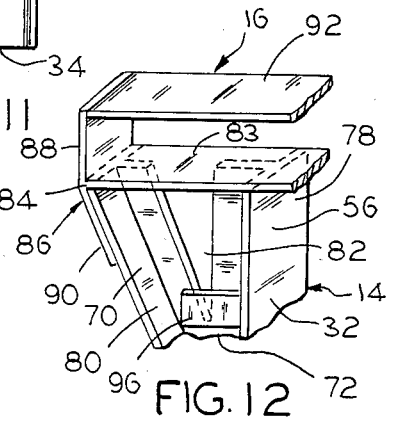
FIG. 12 is a fragmentary perspective view of the mast mounted to the load beam.

As may be seen in FIG. 12, sections 78,80 of the pillar 32 are rigidly attached to the lower member 83 of the substantially "U" shaped load beam 16 near the rear end 84 thereof.

Figure 13:
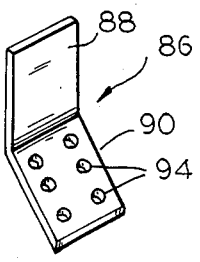
FIG. 13 illustrates a side support plate which is rigidly secured to the rear end of the load beam and to the bent part of the fabricated section.

An angled bracket 86 (FIG. 13) comprising an upper portion 88 and a lower portion 90, more rigidly secures the load beam 16 to the pillar 32. The upper portion 88 of the bracket 86 is secured to the rear end 84 of the load beam 16 including attachment to both the upper and lower members 92,83 thereof, and the lower portion 90 of the bracket 86 is secured to bent section 80 of the pillar 32. Thus, the upper portion 88 of the bracket 86 may be welded to the load beam 16, and thereafter the lower portion 90 of the bracket 86 may be attached to the pillar 32 of the mast 14 with screws passing through openings 94.

A support plate 96 (FIGS. 1 and 12) is welded or otherwise rigidly secured to the web 72 of the pillar 32, to cover the point 75 and the apex of the space 82 for structurally supporting the area around the point 75.

An anti-kick up guard or baffle 98 is secured to the side flange 70 of pillar 32 and spaced from the inside surface 43 of the pipe 24. The baffle 98 stabilizes any oscillatory motion of the pillar 32, particularly when first starting the rotary motion of the mast assembly 14. The baffle 98 is preferably positioned opposed to the boot 42 to prevent "kick-up" of the pillar 32 under the heavier load conditions (FIG.7).

FIGS. 14 through 17 illustrate alternative means for securing the mast 14 to the load beam 16 so that the moment of force is sufficiently distributed for reducing deflection of the load beam under heavy load conditions.

Figure 14:
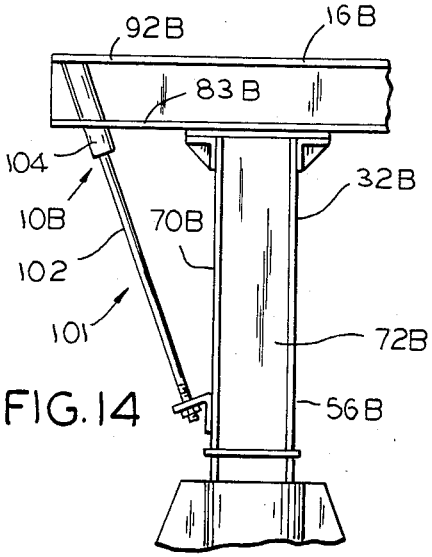
FIG. 14 illustrates a support means comprising a pair of rod members angularly attached to the load beam and to the mast.
Figure 15:
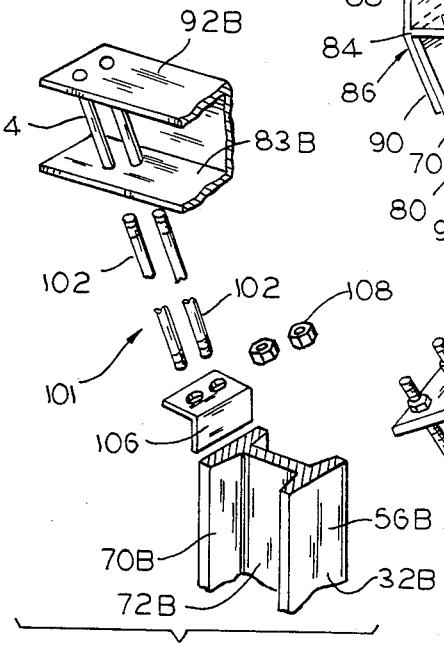
FIG. 15 is a fragmentary perspective view of the support means with the various parts thereof spaced apart prior to assembly.
Figure 16:
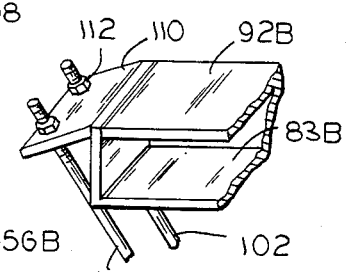
FIG. 16 is a fragmentary perspective view to illustrate an alternative means for attaching the upper end of the support rods to the load beam.
Figure 17:
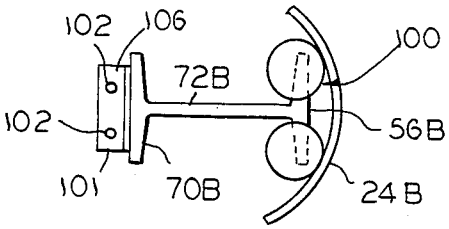
FIG. 17 is a top fragmentary view to show the bottom end of the support means shown in FIG. 14 used with roller means (instead of the bearing boot)

In FIGS. 14 through 17, a jib crane 10B includes a pillar 32B comprising a flange 56B and an opposed flange 70B with a web 72B between. In FIGS. 14 and 15 a moment varying means 101 is shown comprising a pair of rod members 102 threaded at the opposite ends. The rod members 102 are attached at the upper ends to internally threaded tubular members 104 and at the lower ends are secured to an angled bracket 106 with nut members 108. The tubular members 104 are secured to the upper and lower members 92B,83B of the load beam 16B, and the bracket 106 is attached to the flange 70B of pillar 32B. In FIG. 17, the moment varying means 101 is shown used with the roller means 100.

In FIG. 16, the tubular members 104 are replaced with an upper angled bracket 110 and the rod members 102 are secured thereto with upper nut members 112.

Figure 18:
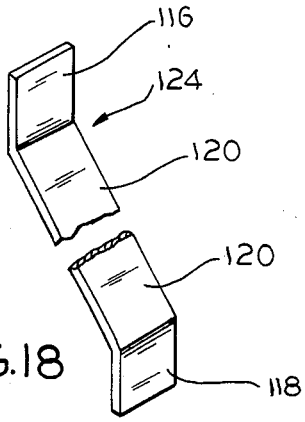
FIG. 18 illustrates an alternative support means utilizing a single elongated bent steel bar of material for rigid attachment at the upper section to the load beam and at the lower section to the mast.

Turning now to FIG. 18, a single piece moment varying means indicated by the reference numeral 114 is shown and includes an upper segment 116 for rigidly attaching to the rear end of the load beam 16b and lower segment 118 for rigidly attaching to the flange 70B of the pillar 32B. A body portion 120 integrally connects the upper segment 116 with the lower segment 118.

Figure 19:
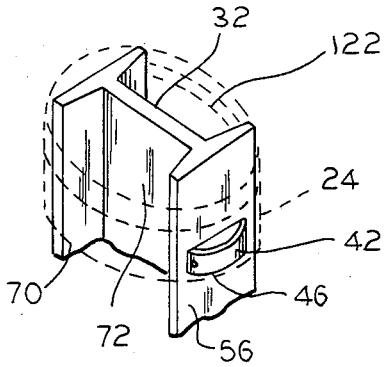
FIG. 19 illustrates the bearing boot means mounted on mast and showing both the cylindrical pipe and metal ring in phantom.
Figure 20:
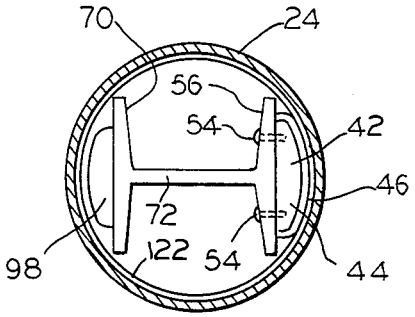
FIG. 20 is a top view showing the bearing boot means in contact with the circular ring.

Turning now to FIGS. 19 and 20, it will be seen that a strap or ring of metal foil 122 is secured to the inside surface 43 of pipe 24 with adhesive or suitable bonding material. The foil 122 may be a suitable stainless steel material, which is substantially smoother than the inside surface 43 of the pipe, and thereby further minimizing the friction between the bearing boot 42 and the pipe 24.

Figure 21:
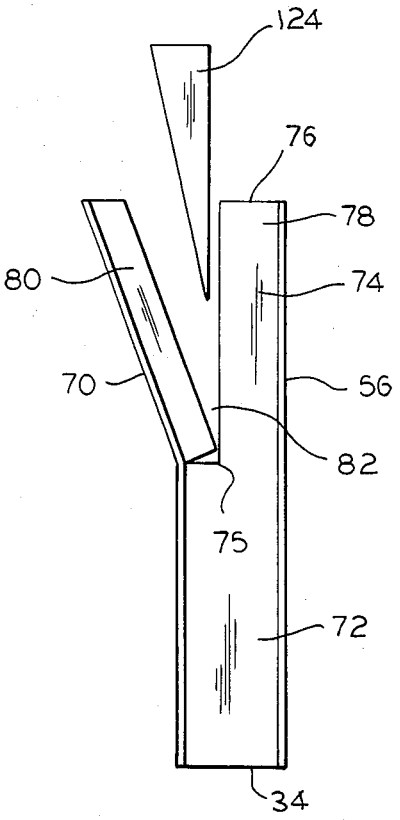
FIG. 21 illustrates the fabricated steel section having an upper part bent away from an adjacent upper part and a piece shaped to fit into the space between the parts being inserted into such space prior to being secured to the parts.

In FIG. 21, a triangular piece 124 is shown spaced from the top end 76 of the beam 32 for inserting into the space 82. Preferably, the piece 124 is constructed from the same material as the beam 32. After the beam is split (see FIGS. 9,10 and 11) and the upper sections 78 and 80 are spread apart, the piece 124 is inserted therebetween and welded to the sections 78 and 80.

Figure 22:
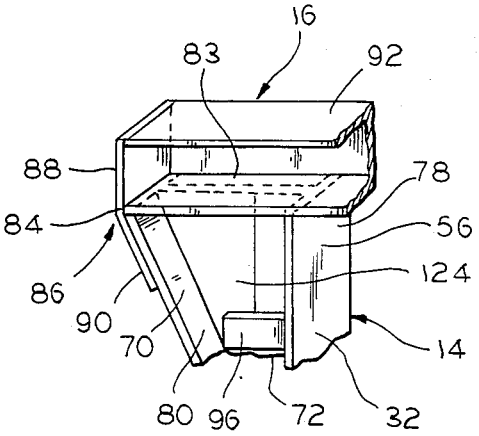
FIG. 22 illustrates the mast beam having the triangular piece secured between the spaced parts of the mast and secured to the load beam, and the various parts are shown fragmented and in perspective.

The upper ends of sections 78,80 and piece 124 are welded to the lower member 83 of the load beam 16. By attaching the piece 124 to the mast beam 16, the width at the upper part of the beam is increased and the load forces are distributed over a larger surface area, to reduce load beam deflection, particularly under full load conditions (refer to FIG. 22).

A metallic paint may be used in place of the strap or ring of foil 122(FIGS. 19 & 20). The paint would smooth out the inside surface 43 and thus function to reduce friction between the inside surface 43 of the pipe and the boot 42. Thus, such painted surface would be substituted for the ring 122 and provide the contacting surface for the bearing boot 42.

The jib crane 10 may be hand rotatable or motor driven (not shown) by coupling the motor shaft to the bearing cup 22 with suitable gearing.

The description of the preferred embodiments of this invention is intended merely as illustrative of the subject invention, the scope and limits of which are set forth in following claims:

We claim:

1. A crane system comprising:

a rotatable mast having an upper end and a lower end, said mast being a beam having a pair of opposed side walls and a web therebetween;

a load beam rigidly attached to the upper end of the mast;

a hollow cylindrical member including an inside circular surface;

a support head rigidly attached to one of said side walls of the mast, said support head having a front surface and a rear surface;

said front surface of the head including end portions connected together by an intermediate portion, said intermediate portion of the head having an arcuate convex shape of substantially the same contour as the inside surface of the cylindrical member;

said rear surface of the head having substantially the same contour as the outside surface of said one side wall and being in contact therewith;

a flexible strip having end parts connected together by an intermediate part, said strip being formed from a material having a coefficient of friction substantially less than the coefficient of friction of said surface of the cylindrical member in contact therewith;

securing means for removably attaching the strip to the head, said strip being flexed to conform to the curvature of said head so tht the end parts and the intermediate part of the strip overlay respectively the end portions and intermediate portion of the front surface of the head, said intermediate part of the strip operatively contacting the inside surface of said cylindrical member and sliding therealong as said mast and load beam are rotated; and a baffle guard secured to the other of said sidewalls in substantially opposed relationship with respect to said head, said baffle guard being spaced from the inside surface of the cylindrical member and contacting said cylindrical member upon lateral movement of the mast.

2. The system of claim 1, wherein said securing means includes screws for removably attaching the end parts of the strip to the head.

3. The system of claim 1, wherein said support head includes a pair of resilient fingers, said contacting strip being resiliently held in place with said fingers, said strip being removable from the support head upon spreading said fingers away from the support head.

4. The crane system of claim 1, wherein said strip is formed from a material comprising a porous bronze structure impregnated with polytetrafluoroethylene and lead and known by the trademark self-lubricting "DU" bearings.

* * * * *